US007028873B1

(12) United States Patent
Collier et al.

(10) Patent No.: US 7,028,873 B1
(45) Date of Patent: Apr. 18, 2006

(54) BACKPACK WITH LUMBAR SUPPORT PLATE

(75) Inventors: Michael Collier, Portland, OR (US); Thomas G. Bell, Portland, OR (US)

(73) Assignee: Nike, Inc., Beaverton, OR (US)

( * ) Notice: Subject to any disclaimer, the term of this patent is extended or adjusted under 35 U.S.C. 154(b) by 307 days.

(21) Appl. No.: 10/637,750

(22) Filed: Aug. 8, 2003

(51) Int. Cl.
*A45F 3/04* (2006.01)

(52) U.S. Cl. ..... 224/628; 224/637; 224/644

(58) Field of Classification Search ..... 224/628, 224/629, 630, 631, 644, 637; 297/284.4; 383/2
See application file for complete search history.

(56) References Cited

U.S. PATENT DOCUMENTS 2,560,406 A * 7/1951 Bergsland ..... 224/636
5,131,576 A * 7/1992 Turnipseed ..... 224/262
5,362,022 A * 11/1994 McLoughlin et al. ..... 248/313
5,553,917 A * 9/1996 Adat et al. ..... 297/230.14
5,626,270 A * 5/1997 Tseng ..... 224/148.7
5,762,243 A * 6/1998 McMaster et al. ..... 224/262
5,823,414 A * 10/1998 Gal et al. ..... 224/637
5,836,489 A * 11/1998 Swetish ..... 224/262
5,890,640 A 4/1999 Thompson
5,902,073 A * 5/1999 Eungard et al. ..... 405/187
6,626,342 B1 * 9/2003 Gleason ..... 224/633
6,802,442 B1 * 10/2004 Thompson ..... 224/637
6,920,879 B1 * 7/2005 Haeuser ..... 128/205.22
2003/0192925 A1 * 10/2003 Boone ..... 224/161

* cited by examiner

*Primary Examiner*—Nathan J. Newhouse
*Assistant Examiner*—Justin M. Larson
(74) *Attorney, Agent, or Firm*—Banner & Witcoff, LTD

(57) ABSTRACT

A backpack includes a backpack body having a body side. A pair of shoulder straps is connected at each end thereof to the backpack body. A semi-rigid support plate is positioned proximate the body side, and a strap is connected to the support plate such that a lower portion of the support plate can be curved while an upper portion of the support plate remains substantially flat.

39 Claims, 5 Drawing Sheets

BACKPACK WITH LUMBAR SUPPORT PLATE

FIELD OF THE INVENTION

This invention relates generally to backpacks, and, in particular, to backpacks having improved lumbar support.

BACKGROUND OF THE INVENTION

Backpacks for carrying items such as books, clothing, and other personal items are well known. Backpacks typically comprise a large central compartment into which the items are placed. Additional compartments and pockets may also be provided to separate items within the backpack. The backpack is typically outfitted with a pair of shoulder straps, and may also have a hip strap, each of which are attached to the backpack and are used by the wearer to carry the backpack.

Such backpacks are known as frameless backpacks, since they have no frame upon which the pack is supported. A frameless backpack does not conform well to a user's body, especially the lower, or lumbar portion of the user's back. Additionally, the weight of a frameless backpack is carried either solely, or in large part, by the shoulders. It is preferable, however, for the weight of a pack to be carried by the hips or by the sacrum. A frameless backpack with shoulder straps cannot effectively transfer the weight of the pack to the sacrum. Although backpacks with internal or external frames are well known, such frames can be cumbersome and expensive. Additionally, backpacks with frames typically have a fixed, non-adjustable configuration.

It is an object of the present invention to provide a backpack that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

In accordance with a first aspect, a backpack includes a backpack body having a body side. A pair of shoulder straps is connected at each end thereof to the backpack body. A semi-rigid support plate is positioned proximate the body side. A strap is connected to the support plate such that a lower portion of the support plate can be curved while an upper portion of the support plate remains substantially flat.

In accordance with another aspect, a backpack includes a backpack body having a body side. A pair of shoulder straps is connected at each end to the backpack body. A semi-rigid lumbar support plate is positioned in the backpack body proximate the body side. A strap is connected to the lumbar support plate such that a lower portion of the lumbar support plate can be curved to substantially follow a contour of a lumbar portion of an individual's spine while an upper portion of the lumbar support plate remains substantially flat.

In accordance with a further aspect, a backpack includes a backpack body having a body side. A pair of shoulder straps is connected at each end thereof to the backpack body. A semi-rigid support plate having a longitudinal axis is positioned proximate the body side of the back body, with a plurality of slots being formed in the support plate along the longitudinal axis. An adjustable fastener is secured to the support plate proximate an upper edge of the support plate. A strap is anchored at a first end thereof to a first end of the support plate, woven through the apertures such that a lower portion of the support plate can be curved while an upper portion of the support plate remains substantially flat, and adjustably connected to the fastener.

In accordance with yet another aspect, a backpack includes a backpack body having a body side. A pair of shoulder straps is connected at each end thereof to the backpack body. A semi-rigid support plate having a longitudinal axis is positioned proximate the body side of the back body, with a plurality of slots being formed in the support plate along the longitudinal axis. An adjustable fastener is secured to the support plate proximate an upper edge of the support plate. A strap is anchored at a first end thereof to a first end of the support plate, woven through the apertures, and adjustably connected to the fastener. The apertures are spaced along the support plate such that such that a lower portion of the support plate can be curved and the remaining portion of the support plate can remain substantially flat.

Substantial advantage is achieved by providing a backpack with a lumbar support plate. In particular, improved lumbar support can be realized with such a lumbar support plate provided within a backpack, allowing a portion of the weight of the backpack to be carried by the sacrum. Further, an adjustable lumbar support plate allows the backpack to be customized to fit different individuals, and to be customized to provide support and comfort for different activities. This is highly advantageous, since there are not only differences in the shape of the backs of different individuals, but also differences in the shape of the back of a particular individual depending on the activity in which they are engaged.

These and additional features and advantages of the invention disclosed here will be further understood from the following detailed disclosure of certain preferred embodiments.

Figure 1:
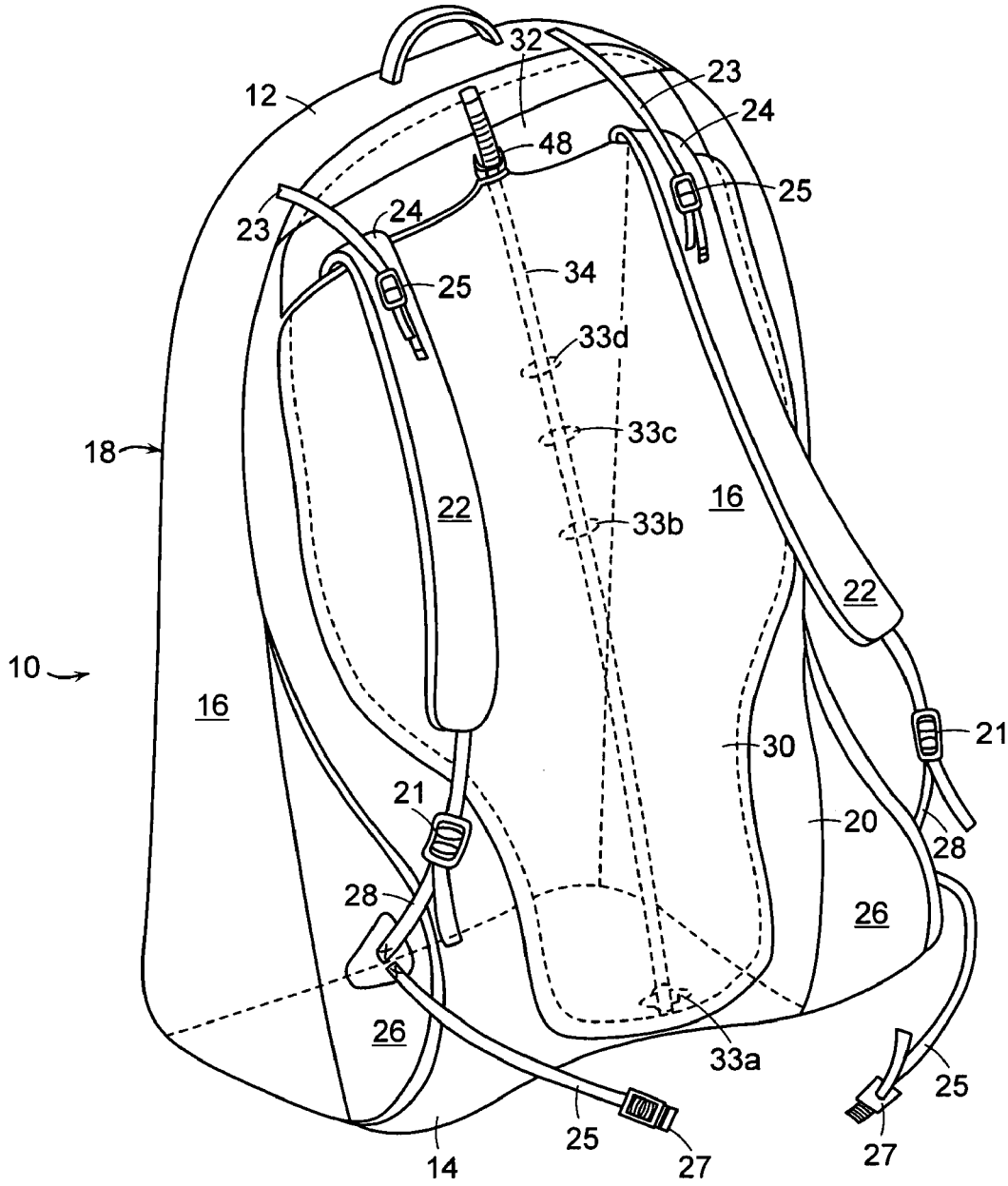
FIG. 1 is a perspective view of a backpack with a lumbar support plate in accordance with a preferred embodiment of the present invention.

The figures referred to above are not drawn necessarily to scale and should be understood to present a representation of the invention, illustrative of the principles involved. Some features of the backpack with a lumbar support plate depicted in the drawings have been enlarged or distorted relative to others to facilitate explanation and understanding. The same reference numbers are used in the drawings for similar or identical components and features shown in various alternative embodiments. Backpacks with lumbar support plates as disclosed herein, will have configurations and components determined, in part, by the intended application and environment in which they are used.

DETAILED DESCRIPTION OF CERTAIN PREFERRED EMBODIMENTS

The present invention may be embodied in various forms. A preferred embodiment of a backpack 10 is shown in FIG. 1. Backpack 10 is formed of a plurality of panels including a top 12, a bottom 14, two lateral sides 16, an outer side 18, and a body side 20. When used herein, the term "outer side" refers to the side of the backpack or other element that faces away from the back of the user wearing the backpack. Accordingly, the term "body side" refers to the side of the backpack or other element that faces the back of a user.

When connected, these six panels or sides define an interior compartment in backpack 10 into which items such as books, food, clothing, etc. may be placed. The interior compartment of backpack 10 may be subdivided into compartments, and additional compartments may be added in order to keep various items separate from one another, thereby providing easy access to frequently used items, and allowing for the proper weight distribution and comfort to the wearer.

Although six particular sides or panels are described, backpack 10 can comprise fewer or more panels or sides, and be within the scope of the invention. For instance, each of the body, top, bottom, outer, and lateral sides can be comprised of one continuous piece of fabric with no actual seams or junctures. Alternatively, backpack 10 could even be formed with ten or more panels or sides and corresponding seams or junctures therebetween.

The panels making up backpack 10, as well as the straps and other components of the invention can variously comprise a number of natural or synthetic materials. Natural fabric such as leather, cotton (especially canvas or single-filled duck) and the like may be useful for certain applications. Exemplary materials are synthetic fabrics made from thermoplastic materials such as polypropylene, polyvinyl chloride, polyamide (such as nylon), polyethylene, polyester, etc. In certain preferred embodiments, nylon is used, which can be textured for breathability, wear-resistance, and waterproofed with materials such as silicone elastomers and the like. Particularly useful is a type of nylon known as Cordura (provided by E.I. du Pont de Nemours & Co., Wilmington, Del.). Multiple or composite layer configurations as are well-known in the art, in which a tougher, more durable weave comprises an outer layer while a lighter, thinner, and more flexible inner weave comprises an inner layer. Some of these materials known in the industry, such as Gore-Tex (provided by W. L. Gore & Associates, Newark, Del.), Tri-Shield (provided by Tri-Seal International, Blauvelt, N.Y.), Spandura (provided by H. Warsaw & Sons, New York, N.Y.), etc. can be used as appropriate.

A pair of shoulder straps 22 are secured at first and second ends thereof to backpack 10, with each shoulder strap including an adjustable buckle 21. A first or upper end 24 of each shoulder strap 22 is secured to an upper portion of body side 20. In certain preferred embodiments, a load lift strap 23 connects each shoulder strap 22 to top 12 of backpack 10. Load lift straps 23 are typically connected to shoulder strap 22 and top 12 by stitching or other suitable means, and include an adjustable buckle 25.

Thus, the length of load lift straps 23 can be adjusted to transfer the load in backpack 10 toward the user, in order to stabilize the backpack and to effectively distribute the weight of the backpack.

In a preferred embodiment, a pair of hip portions 26 extend outwardly from a lower portion of backpack 10 at the juncture between each lateral side 16 and body side 20. A second or lower end 28 of each shoulder strap 22 is secured to a corresponding hip portion 26 by stitching or other suitable means. A hip strap 25 is secured at opposite ends thereof to hip portions 26, with a buckle 27 or other suitable connector connecting first and second portions of hip strap 25.

A pad 30 may be secured to body side 20 of backpack 10 by stitching or other suitable means. For example, in certain embodiments, pad 30 could be placed within a sleeve formed in backpack 10. Pad 30 is formed of foam, such as molded ethyl vinyl acetate (EVA), or any other suitable material that provides cushioning for the back of the individual carrying backpack 10.

A semi-rigid support plate 32 is provided in backpack 10 adjacent body side 20. In the illustrated embodiment, with pad 30 secured to body side 20, support plate 32 is positioned between body side 20 and pad 30. As can be seen more clearly in a preferred embodiment shown in FIG. 2, a bottom portion of support plate 32 is narrower than the remaining portion, which allows for backpack 10 to more effectively wrap around the back toward the hips of a user. A support plate that is too wide will prevent backpack 10 from easily wrapping around the user's back. It is to be appreciated that the entire support plate could have the same width.

Figure 2:
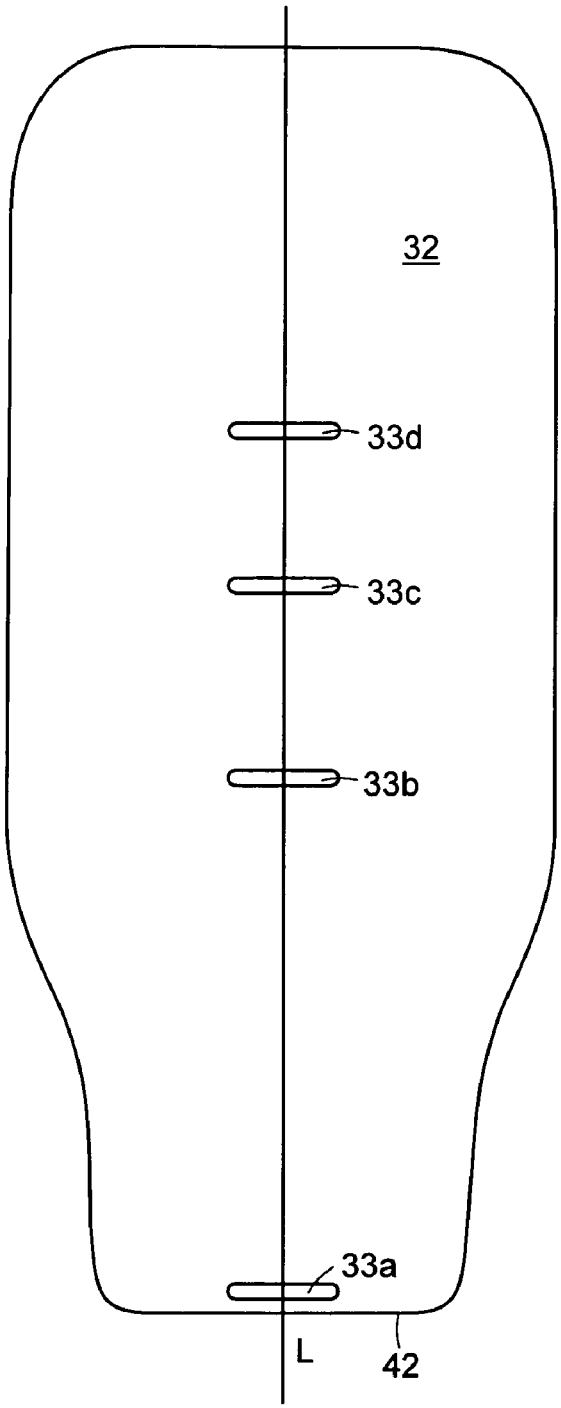
FIG. 2 is an elevation view of the support plate of the backpack of FIG. 1.
Figure 3:
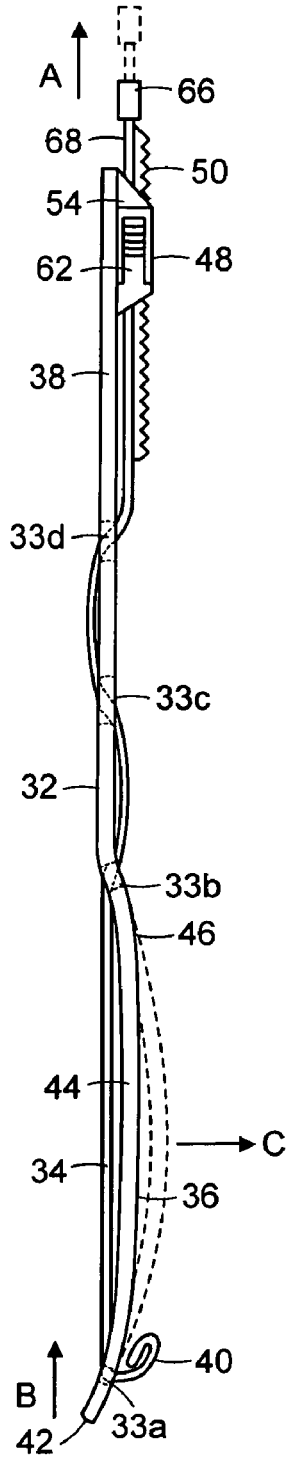
FIG. 3 is a side elevation view of the support plate of the backpack of FIG. 1, shown with a strap adjustably secured to the support plate.

As can be seen in FIG. 2, support plate 32 has a longitudinal axis L, along which a plurality of apertures is disposed. In the illustrated embodiment, four apertures 33*a–d* are provided. As can be seen in FIGS. 1, 3, a strap 34 is woven through apertures 33*a–d* and connected to support plate 32 in such a manner as to allow a lower portion 36 of support plate 32 to bend, while an upper portion 38 of support plate 32 remains substantially flat. As can be seen in FIG. 3, lower portion 36 can be bent or curved in a manner such that it closely follows or mimics the curvature of the lumbar portion of an individual's back. This advantageously allows much of the weight of the backpack to be supported by the user's sacrum.

In other preferred embodiments, aperture 33*b* can be placed closer to lower edge 42 such that the curvature of lower portion 36 is more pronounced. In such embodiments, the lower portion of backpack 10 will stand off, or be spaced from the user's back, allowing ventilation, while at the same time providing support for the weight of the pack on the sacrum.

It is to be appreciated that apertures 33*a–d* may be in the form of slots as illustrated herein, or may take any other suitable form, including, for example, circular, rectangular, oval, or any other suitable shape that allows a strap to pass therethrough.

In the illustrated embodiment, a first end 40 of strap 34 is anchored to support plate 32 at lowermost aperture 33*a* proximate a lower edge 42 of support plate 32. As illustrated, strap 34 is folded over and sewn to itself at first end 40. The bulk of the folded over first end 40 is caught on the edge of aperture 33*a*, thereby anchoring first end 40. It is to be appreciated that first end 40 of strap 34 could be anchored or secured to lumbar support plate 32 proximate lower edge 42 by any of many other suitable means, including being directly secured to lumbar support plate 32 without the need for aperture 33*a*. For example, strap 34 could be riveted to support plate 32, secured by adhesive, or fastened in any other fashion. Suitable means of securing first end 40 of strap 34 to support plate 32 will become readily apparent to those skilled in the art, given the benefit of this disclosure.

Strap 34 extends from aperture 33*a* to the next adjacent aperture 33*b* on the outer side 44 of support plate 32. Strap 34 extends through aperture 33*b*, along body side 46 of support plate 32, through aperture 33*c*, along outer side 44, and back through aperture 33*d*. From aperture 33*d*, strap 34 extends along body side 46 and through an adjustable fastener 48.

Figure 4:
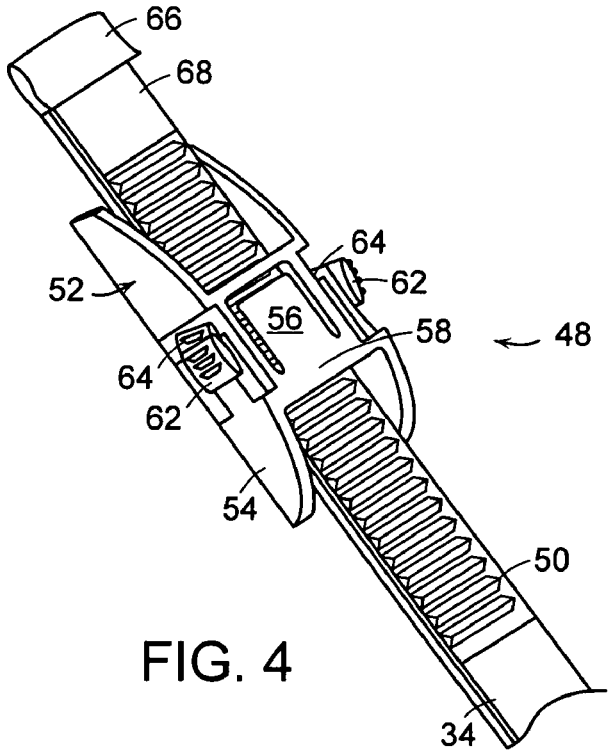
FIG. 4 is a perspective view of the strap and fastener of FIG. 1.

Adjustable fastener 48 can take many forms. In the preferred embodiment illustrated in FIG. 4 fastener 48 includes a series of ridges 50 on strap 34 and a mating buckle 52 secured to lumbar support plate 32. Buckle 52 includes a base portion 54 and a lever arm 56 having a first end 58 in pivotal connection with base portion 54. A second end 60 of lever arm 56 has a downwardly extending projection (not visible) that engages a corresponding ridge 50, thereby retaining strap 34 in a fixed position. To release strap 34, a user squeezes the two release members 62 positioned on opposed sides of base portion 54. As release members 62 are squeezed, projections 64 on release members 62 engage an under surface of lever arm 56, forcing it upward and releasing strap 34. A gripping element 66, formed of rubber or other suitable material, is secured to upper end 68 of strap 34, providing firm purchase for a user's fingers as they attempt to tighten strap 34.

It is to be appreciated that fastener 48 can have any of numerous configurations, including for example, D-ring fasteners, ratchets, cord-locks, or strap locks. Other suitable configurations for an adjustable fastener for strap 34 will become readily apparent to those skilled in the art, given the benefit of this disclosure.

The amount that lower portion 36 is curved can be altered simply by lengthening or shortening the length of strap 34 between lower edge 42 and aperture 33*b*, as illustrated in FIG. 3, where support plate 32 is shown in solid lines in a first state with lower portion 36 slightly curved, and in dashed lines in a second state, where lower portion 36 is curved to a greater extent. To increase the curvature of lower portion 36, upper end 68 of strap 34 is pulled upwardly in the direction of arrow A through fastener 48, thereby increasing tension in strap 34 and pulling lower edge 42 of lumbar support plate 32 upwardly in the direction of arrow B. This causes lower portion 36 to bend outwardly in the direction of arrow C, between lowermost aperture 33*a* and aperture 33*b*. Apertures 33*c* and 33*d* are spaced apart from one another in a manner that allows strap 34 to be woven through apertures 33*c*, 33*d* without causing the upper portion 38 of lumbar support plate 32 to bend and allowing it to remain substantially flat.

Thus, strap 34 can easily be adjusted to vary the curvature of lower portion 36. This feature advantageously allows the backpack to be adjusted to fit a particular user's body shape. This feature also allows an adjustment of the curvature of lower portion 36 to match the activity of the user and/or increase the load bearing on the hips of the user. For example, when riding a bike, the user is bent forward toward the handlebars so that their lower back straightens, removing the natural lumbar curve. In such a situation, the user would loosen strap 34 such that lower portion 36, and, therefore, all of support plate 32, is substantially flat. On the other hand, when the user will be walking, strap 34 can be tightened to induce a curvature in lower portion 36. Further, when the user will be running, strap 34 can be tightened even further, such that there is a greater curvature to lower portion 36.

Figure 5:
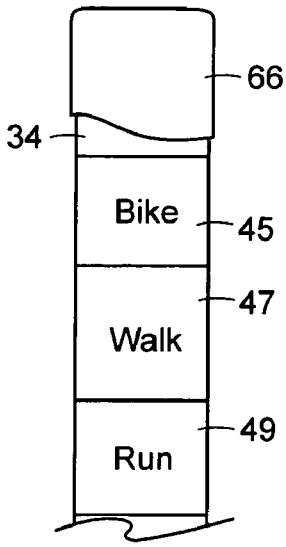
FIG. 5 is an elevation view of an indicator on the strap of the backpack of FIG. 1.

In another embodiment, as illustrated in FIG. 5, a plurality of indicators may be used to provide a visual indication to the user of the degree to which lower portion 36 is curved. In the illustrated embodiment, three indicators are used. A first indicator 45 is used to denote the substantially flat condition of lower portion 36. A second indicator 47 is used to denote a first degree of curvature of lower portion 36. A third indicator 49 is used to denote a second, or more severe degree of curvature of lower portion 36. It is to be appreciated that any number of indicators can be used to denote any number of degrees of curvature of lower portion 36. Indicators 45, 47, 49 may be color coded indicators, or may include a symbol, e.g., text, to indicate the degree of curvature of lower portion 36. In the illustrated example, text is used for the indicators; first indicator 45 is labeled "BIKE," second indicator 47 is labeled "WALK," and third indicator 49 is labeled "RUN," with each of the three indicators corresponding to the degree of curvature of lower portion 36 that is most suitable for that activity.

Figure 6:
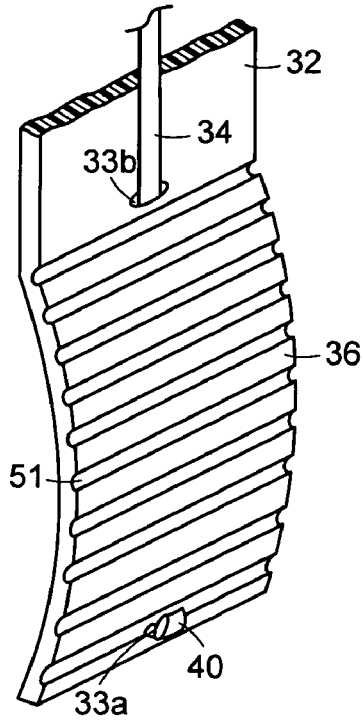
FIG. 6 is a perspective view of an alternative embodiment of the support plate of the backpack of FIG. 1.

In certain preferred embodiments, as illustrated in FIG. 6, support plate 32 has grooves 51 formed into its surface. Grooves 51 provide additional flexibility for support plate 32 as strap 34 is tightened and lower portion 36 of support plate 23 is bent. In the illustrated embodiment, grooves 51 are formed only in lower portion 36. It is to be appreciated however, that grooves 51 may be formed in all or any part of support plate 32.

Figure 7:
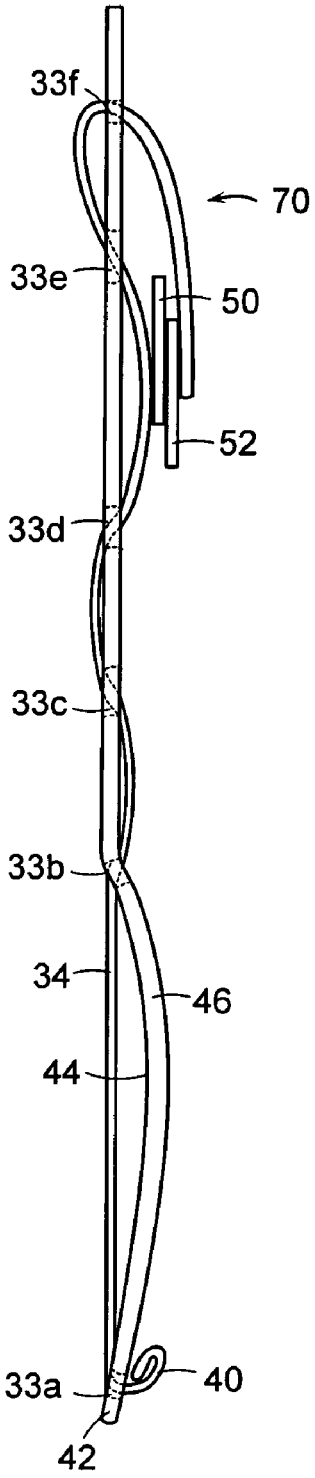
FIG. 7 is a side elevation view of the support plate and strap of the backpack of FIG. 1, shown with an alternative embodiment of the fastener.

In another preferred embodiment, illustrated in FIG. 7, lumbar support plate 32 has six apertures 33*a–f* disposed along longitudinal axis L. Strap 34 extends along outer side 44 of lumbar support plate 32 between apertures 33*a* and 33*b*, along body side 46 between apertures 33*b* and 33*c*, along outer side 44 between apertures 33*c* and 33*d*, along body side 46 between apertures 33*d* and 33*e*, and along outer side 44 between apertures 33*e* and 33*f*. In this embodiment, a fastener 70 takes the form of a hook and loop fastener. A first portion 50 and a second portion 52 of hook and loop fastener 70 are secured to strap 34. As strap 34 passes through aperture 33*f*, it is folded back down and secured to itself by way of hook and loop fastener 70.

It is to be appreciated that the number of apertures disposed along upper portion 38 of support plate 32, which remains substantially flat, may vary. Factors that affect the number of apertures include the length of the board and the material of which strap 34 is formed.

Figure 8:
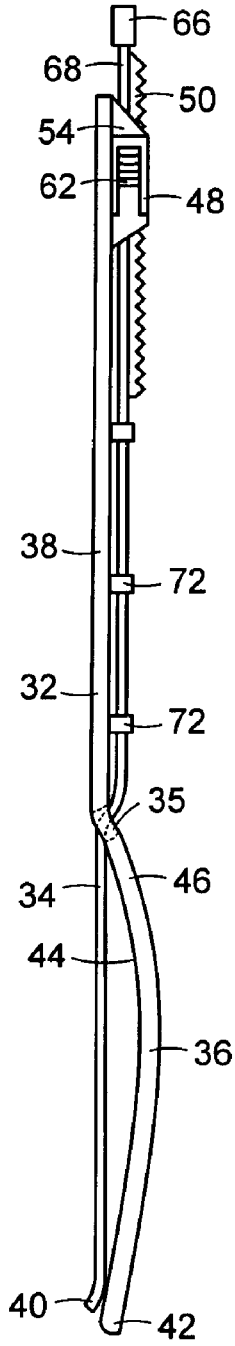
FIG. 8 is a side elevation of an alternative embodiment of the support plate of the backpack of FIG. 1.

Another preferred embodiment is illustrated in FIG. 8, in which lumbar support plate 32 has a single aperture 35. Strap 34 is secured to lumbar support plate 32 proximate lower edge 42 and extends along outer side 44 until it passes through aperture 35. Strap 34 then extends along body side 46 and passes through a plurality of retaining members 72 until it reaches fastener 48. Retaining members 72 allow strap 34 to pass freely therethrough, while at the same time keeping strap 34 in close proximity to lumbar support plate 32. In the illustrated embodiment, retaining members 72 comprise loops of material (e.g., plastic, fabric, etc.) through which strap 34 passes. Thus, with a single aperture 35, a plurality of retaining members 72, and fastener 48, strap 34 can be adjusted to allow lower portion 36 of lumbar support plate 32 to bend, while at the same time allowing upper portion 38 to remain substantially flat.

Figure 9:
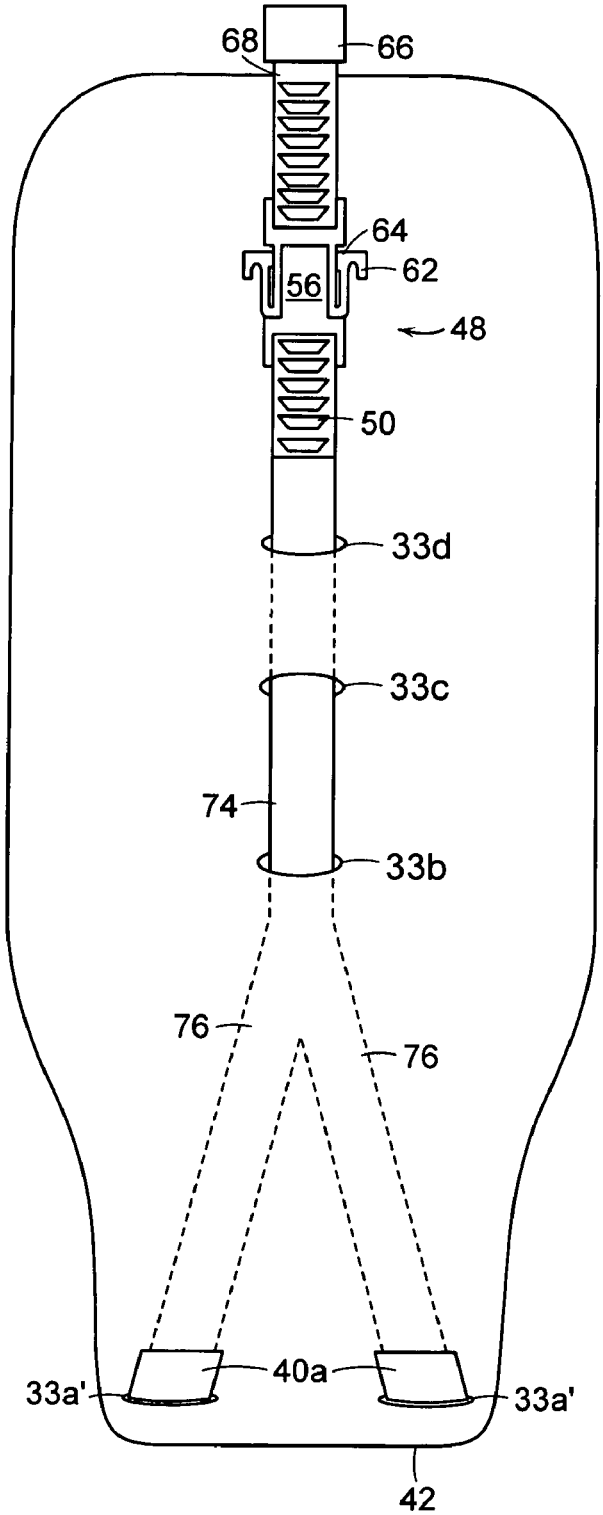
FIG. 9 is an elevation view of an alternative embodiment of a strap shown secured the support plate of the backpack of FIG. 1.

In certain preferred embodiments, strap 34 may be formed of multiple components, rather than be formed of one continuous piece of material or webbing. For example, in one preferred embodiment shown in FIG. 9, a strap 34' comprises an upper portion 74 and two lower portions 76. Upper ends of lower portions 76 are connected to a lower end of upper portion 74, and anchored at their lower ends 40' to apertures 33*a*' formed in lumbar support plate 32. It is to be appreciated that other configurations of strap 34 are possible, including embodiments where the upper portion of strap 34 is formed of multiple components.

Figure 10:
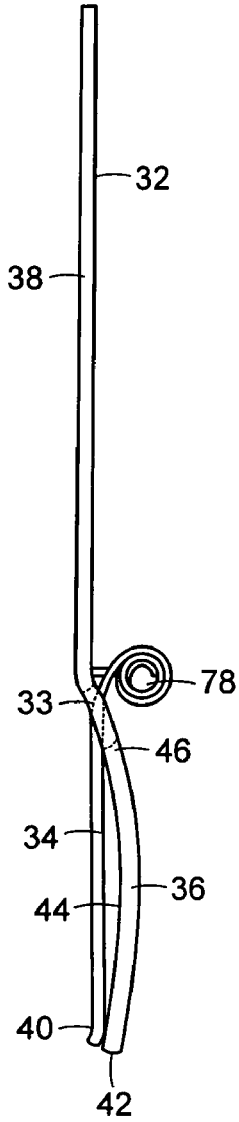
FIG. 10 is a side elevation view of an alternative embodiment of a strap shown secured the support plate of the backpack of FIG. 1.

In other preferred embodiments, strap 34 need not extend the entire height of lumbar support plate 32. In the embodiment illustrated in FIG. 10, strap 34 is anchored at first end 40 proximate lower edge 42. Strap 34 passes through aperture 35 and is secured there by a fastener 78. Fastener 78 may have a configuration as described above, or fastener 78 may be a cylindrical member about which strap 34 is wrapped. Fastener 78 may have a ratcheting mechanism that allows strap 34 to be tightened, and released. Suitable configurations for fastener 78 will become readily apparent to those skilled in the art, given the benefit of this disclosure.

Lumbar support plate 32 may be formed of any suitable semi-rigid material that provides some support and structure for backpack 10, yet remains flexible enough to be curved when strap 34 is shortened and return to a planar form when strap 34 is lengthened. Exemplary materials for support plate 32 include, but are not limited to, polyethylene, polypropylene, and polyvinylchloride. Other suitable materials will become readily apparent to those skilled in the art, given the benefit of this disclosure.

Strap 34 may be formed of webbing, cord, cable or any other material suitable of being secured at the lower end of support plate 32 and adjustably connected to the upper end of support plate 32, and that can be pulled to vary the amount that lower portion 36 is bent or curved. In one preferred embodiment, strap 34 is formed of nylon webbing.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A backpack comprising, in combination:

a backpack body having a body side;

a pair of shoulder straps connected at each end thereof to the backpack body;

a semi-rigid support plate proximate the body side and having an upper portion and a lower portion; and a strap connected to the support plate such that pulling on the strap will cause a lower edge of the support plate to be moved upwardly toward the upper portion, causing the lower portion of the support plate to curve outwardly while an upper portion of the support plate remains substantially flat.

2. The backpack of claim 1, wherein the strap is adjustably connected to the support plate.

3. The backpack of claim 1, wherein a first end of the strap is anchored to the support plate proximate the lower edge of the support plate and a second end of the strap is releasably connected to the support plate proximate an upper edge of the support plate.

4. The backpack of claim 3, wherein the support plate includes a plurality of apertures, through which the strap is woven.

5. The backpack of claim 4, wherein the strap extends between a lowermost of the apertures and an adjacent aperture on an outer side of the support plate.

6. The backpack of claim 4, wherein the apertures are in the form of slots.

7. The backpack of claim 4, wherein the support plate includes four apertures.

8. The backpack of claim 4, wherein the support plate includes six apertures.

9. The backpack of claim 4, wherein the apertures are formed along a longitudinal axis of the support plate.

10. The backpack of claim 1, wherein the backpack body includes a pad secured to the body side of the backpack, the support plate being positioned between the pad and the body side.

11. The backpack of claim 1, further comprising an adjustable fastener through which an upper end of the strap extends.

12. The backpack of claim 11, wherein the fastener comprises a plurality of ridges on the strap and a fastener on the support plate and having a movable projection engageable with the ridges.

13. The backpack of claim 1, wherein the support plate is formed of polypropylene.

14. The backpack of claim 1, wherein the support plate is formed of polyethylene.

15. The backpack of claim 1, further comprising a hip strap connected at opposite ends thereof to the backpack body.

16. The backpack of claim 1, wherein the strap includes a plurality of indicators that provide an indication of the degree of curvature of the lower portion of the support plate.

17. The backpack of claim 1, further comprising a plurality of scoring lines formed on a surface of the lower portion of the support plate.

18. The backpack of claim 1, wherein the strap comprises multiple portions and is anchored to the support plate at two locations proximate the lower edge of the support plate.

19. A backpack comprising, in combination:

a backpack body having a body side;

a pair of shoulder straps connected at each end to the backpack body;

a semi-rigid lumbar support plate positioned in the backpack body proximate the body side; and a strap connected to the lumbar support plate such that pulling on the strap will cause a lower edge of the support plate to be moved upwardly, causing a lower portion of the lumbar support plate to be curved to substantially follow a contour of a lumbar portion of an individual's spine while an upper portion of the lumbar support plate remains substantially flat.

20. The backpack of claim 19, wherein the strap is adjustably connected to the lumbar support plate.

21. The backpack of claim 19, wherein a first end of the strap is anchored to the lumbar support plate proximate a lower edge of the lumbar support plate and a second end of the strap is releasably connected to the lumbar support plate proximate an upper edge of the lumbar support plate.

22. The backpack of claim 19, wherein the lumbar support plate includes a plurality of apertures, through which the strap is woven.

23. The backpack of claim 22, wherein the strap extends between a lowermost of the apertures and an adjacent aperture on an outer side of the lumbar support plate.

24. The backpack of claim 22, wherein the apertures are in the form of slots.

25. The backpack of claim 22, wherein the support plate includes four apertures.

26. The backpack of claim 22, wherein the support plate includes six apertures.

27. The backpack of claim 22, wherein the apertures are formed along a longitudinal axis of the lumbar support plate.

28. The backpack of claim 19, wherein the backpack body includes a pad secured to the body side of the backpack, the lumbar support plate being positioned between the pad and the body side.

29. The backpack of claim 19, further comprising an adjustable fastener through which an upper end of the strap extends.

30. The backpack of claim 29, wherein the fastener comprises a plurality of ridges on the strap and a fastener on the lumbar support plate and having a movable projection engageable with the ridges.

31. The backpack of claim 19, wherein the lumbar support plate is formed of polypropylene.

32. The backpack of claim 19, wherein the lumbar support plate is formed of polyethylene.

33. The backpack of claim 19, further comprising a hip strap connected at opposite ends thereof to the backpack body.

34. The backpack of claim 19, wherein the strap includes a plurality of indicators that provide an indication of the degree of curvature of the lower portion of the lumbar support plate.

35. The backpack of claim 19, further comprising a plurality of scoring lines formed on a surface of the lower portion of the support plate.

36. A backpack comprising, in combination:

a backpack body having a body side;

a pair of shoulder straps connected at each end thereof to the backpack body;

a semi-rigid support plate having a longitudinal axis and positioned proximate the body side of the back body, a plurality of slots being formed in the support plate along the longitudinal axis, an adjustable fastener secured to the support plate proximate an upper edge of the support plate; and a strap anchored at a first end thereof to a first end of the support plate, woven through the apertures such that a lower portion of the support plate can be curved while an upper portion of the support plate remains substantially flat, and adjustably connected to the fastener.

37. The backpack of claim 36, further comprising a hip strap connected at each end thereof to the backpack body.

38. A backpack comprising, in combination:

a backpack body having a body side;

a pair of shoulder straps connected at each end thereof to the backpack body;

a semi-rigid support plate having a longitudinal axis and positioned proximate the body side of the back body, a plurality of slots being formed in the support plate along the longitudinal axis, an adjustable fastener secured to the support plate proximate an upper edge of the support plate; and a strap anchored at a first end thereof to a first end of the support plate, woven through the apertures, and adjustably connected to the fastener;

wherein the apertures are spaced along the support plate such that such that a lower portion of the support plate can be curved and the remaining portion of the support plate can remain substantially flat.

39. The backpack of claim 38, further comprising a hip strap connected at each end thereof to the backpack body.

* * * * *